US008905446B2

(12) United States Patent
Farmer

(10) Patent No.: US 8,905,446 B2
(45) Date of Patent: Dec. 9, 2014

(54) WASTE COLLECTION DEVICE

(71) Applicant: William Cannon Farmer, El Paso, TX (US)

(72) Inventor: William Cannon Farmer, El Paso, TX (US)

( * ) Notice: Subject to any disclaimer, the term of this patent is extended or adjusted under 35 U.S.C. 154(b) by 0 days.

(21) Appl. No.: 13/902,897

(22) Filed: May 27, 2013

(65) Prior Publication Data

US 2014/0152032 A1 Jun. 5, 2014

Related U.S. Application Data

(63) Continuation of application No. 13/416,753, filed on Mar. 9, 2012, now Pat. No. 8,449,007.

(51) Int. Cl.
*A01K 29/00* (2006.01)
*E01H 1/12* (2006.01)

(52) U.S. Cl.
CPC ..... *E01H 1/1206* (2013.01); *E01H 2001/1293* (2013.01)
USPC ..... 294/1.4

(58) Field of Classification Search
CPC ..... E01H 1/1206; E01H 2001/1293
USPC ..... 294/1.3, 1.4, 1.5, 19.2, 209; 15/257.1, 15/257.5, 257.6, 104.8
See application file for complete search history.

(56) References Cited

U.S. PATENT DOCUMENTS

| | | | | | |
|---|---|---|---|---|---|
| 3,431,008 | A * | 3/1969 | Narita | 294/1.4 |
| 3,757,737 | A * | 9/1973 | Drum et al. | 294/1.4 |
| 4,148,513 | A * | 4/1979 | Gagne | 294/1.4 |
| 4,200,321 | A * | 4/1980 | Warkentin | 294/1.4 |
| 4,221,415 | A * | 9/1980 | Ganz | 294/1.4 |
| 4,705,310 | A * | 11/1987 | Scripter | 294/1.4 |
| 4,896,912 | A * | 1/1990 | Parnell | 294/1.3 |
| 4,958,871 | A * | 9/1990 | Hemans | 294/1.4 |
| 5,039,149 | A * | 8/1991 | Gish | 294/1.4 |
| 5,400,572 | A * | 3/1995 | Peck et al. | 53/459 |
| 5,503,442 | A * | 4/1996 | Lee | 294/1.4 |
| 5,540,470 | A * | 7/1996 | Lu | 294/1.4 |
| 5,899,510 | A * | 5/1999 | Hayes et al. | 294/1.4 |
| 6,039,370 | A * | 3/2000 | Dooley et al. | 294/1.5 |
| 6,086,123 | A * | 7/2000 | Sowinski et al. | 294/1.3 |
| 6,095,579 | A * | 8/2000 | Nichols | 294/1.3 |
| 6,126,215 | A * | 10/2000 | Jahns | 294/1.3 |
| 6,135,520 | A * | 10/2000 | Miller et al. | 294/1.4 |
| 6,227,149 | B1 * | 5/2001 | Host et al. | 119/867 |
| 6,386,606 | B1 * | 5/2002 | Marshall | 294/1.5 |
| 6,485,073 | B2 * | 11/2002 | Harrison | 294/1.4 |
| 6,648,387 | B2 * | 11/2003 | Kaplan | 294/1.5 |
| 6,702,349 | B2 * | 3/2004 | Clements | 294/1.5 |
| 6,942,264 | B1 * | 9/2005 | Mendez | 294/1.5 |
| 7,188,878 | B1 * | 3/2007 | Kraus | 294/1.4 |
| 7,401,826 | B1 * | 7/2008 | Marrett | 294/1.4 |
| 7,448,659 | B1 * | 11/2008 | Auseklis | 294/1.4 |
| 7,618,073 | B2 * | 11/2009 | Casper | 294/1.4 |
| 7,870,835 | B2 * | 1/2011 | Amerena | 119/161 |
| 8,201,862 | B2 * | 6/2012 | Langley | 294/1.3 |
| 8,449,007 | B2 * | 5/2013 | Farmer | 294/1.4 |
| 2008/0048463 | A1 * | 2/2008 | Selenke et al. | 294/1.3 |

* cited by examiner

*Primary Examiner* — Dean Kramer
(74) *Attorney, Agent, or Firm* — James L. Farmer

(57) ABSTRACT

Methods and apparatus are provided for a hand held device for collecting waste material deposits. In one exemplary embodiment the device comprises a frame with a grip portion, and a waste receptacle with an open end for receiving a waste material deposit. The exemplary device may further comprise a pivoting scoop adapted to swing between a loading position in which the scoop extends generally away from the grip end of the frame, and a dispensing position in which the scoop is generally juxtaposed with the open end of the waste receptacle.

23 Claims, 17 Drawing Sheets

Fig. 22a
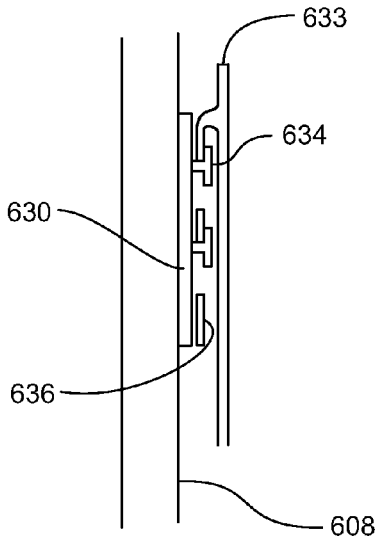
Fig. 22b
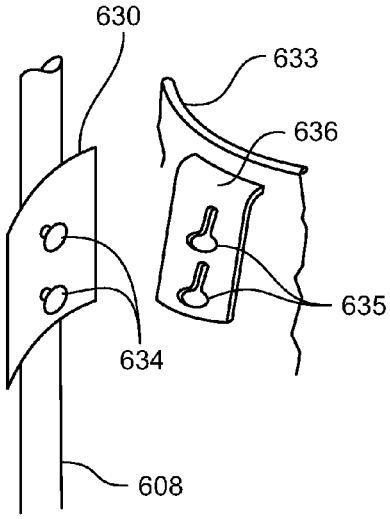
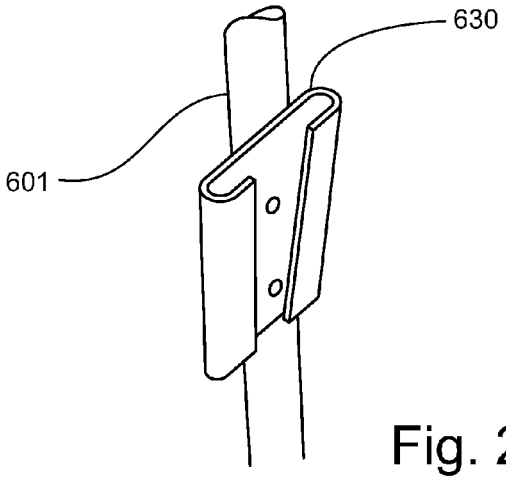
Fig. 22c

WASTE COLLECTION DEVICE

TECHNICAL FIELD AND BACKGROUND

The present invention generally relates to devices for collecting and disposing of waste material, and more particularly relates to hand-held mechanical devices for removing animal excrement from lawns, landscaping, and other inhabited areas.

BRIEF DESCRIPTION OF THE DRAWINGS

In the accompanying drawings:

FIGS. 22*a* and 22*b* depict a flange and keyhole arrangement for detachably connecting the receptacle to the handle of the waste collection device of FIG. 21;

FIG. 22*c* is a tapered pocket arrangement for detachably connecting the receptacle to the handle of the waste collection device of FIG. 21;

DESCRIPTION OF THE EMBODIMENTS

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
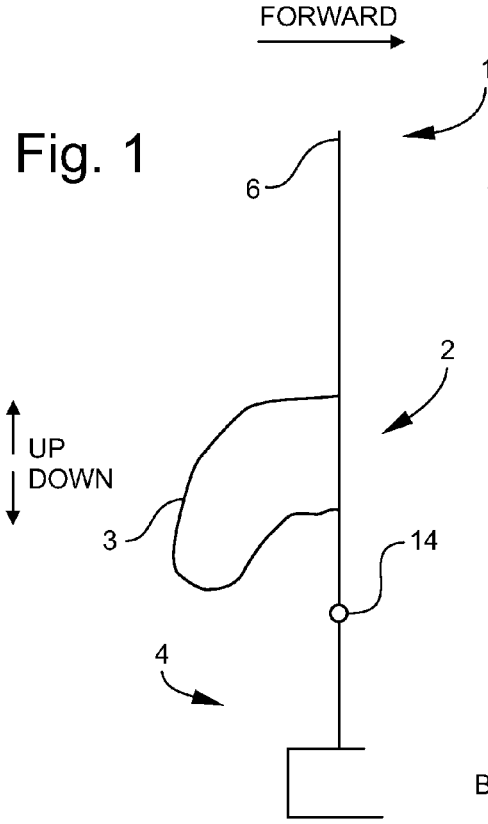
FIG. 1 is a schematic side view of an exemplary waste collection device in accordance with the present disclosure.
Figure 2:
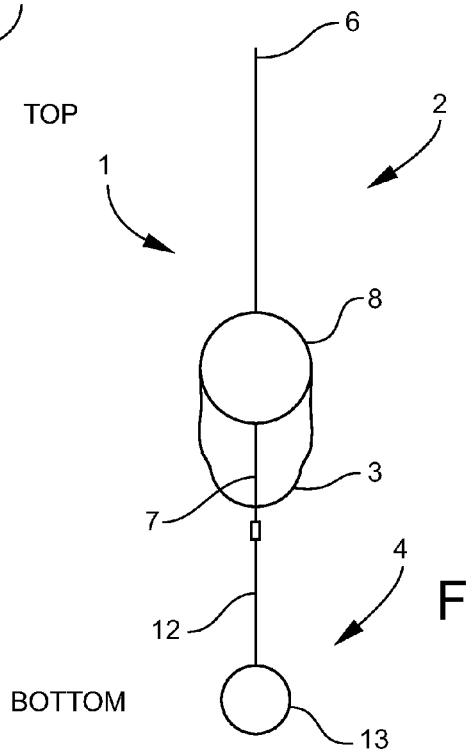
FIG. 2 is a schematic front view of another exemplary embodiment of a waste collection device shown in the loading position.

Referring specifically to the drawing figures, an exemplary waste collection device in accordance with the present disclosure is shown in FIGS. 1 though 3, and indicated generally at reference numeral 1. The waste collection device 1 comprises a handle, or frame 2 with a grip end 6, a waste receptacle 3, and a pivoting scoop 4. The waste receptacle 3 is an open ended container, such as for example a loose bag, a flexible basket, or a rigid canister. Receptacle 3 may comprise an integral portion of the frame 2, or an independent element permanently or detachably connected to the waste collection device. In one exemplary embodiment shown in FIG. 2, waste receptacle 3 is supported by a rigid structural opening 8 that forms an integral portion of the frame 2. It should be noted that the terms "handle" and "frame" may be used interchangeably herein as referring to a structural member extending from the grip end 6, and possibly including other structural elements such as the above mentioned structural opening 8, or even a lower frame portion as indicated at reference numeral 7 in FIG. 2.

Figure 3:
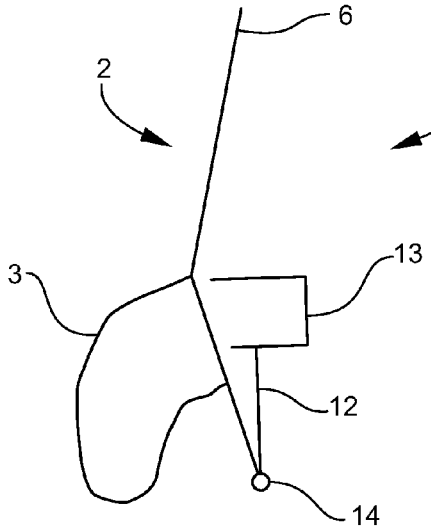
FIG. 3 is a schematic side view of an exemplary waste collection device shown in the dispensing position.

The scoop 4 comprises a scooping surface, such as for example a shovel, a dust pan, or the bottom side of the depicted open ended cup 13, adapted to be slid underneath a waste material deposit. The scooping surface may be at the lower end of a scoop arm 12 that is pivotally connected to the waste collection device. In the depicted embodiments of FIGS. 1 through 3 the scoop 4 is pivotally connected directly to frame 2 at a scoop pivot joint 14, although other connection arrangements are possible as will be explained further below in reference to additional embodiments. The scooping surface and scoop arm may be one integral part, or separate elements fastened or bonded together. The scoop 4 is rotatable about the pivot joint 14 from a loading position, as shown in FIG. 1 with the scoop extended generally downward and away from grip end 6, to a dispensing position as shown in FIG. 3 where the scoop has rotated about pivot joint 14 to a position with the opening of cup 13 directly juxtaposed, or partially inside the open end of receptacle 3.

In order to better facilitate descriptions of the relative orientation of the various components with respect to each other, and with respect to the ground or a human operator, an orientation convention will be defined. Referring again to FIG. 1, the end of the collection device with the grip 6 is the upper end or top, and the opposite end of the device with the scoop 4 is the lower end or bottom. Forward refers to the direction toward which the scooping surface of scoop 4 faces when the scoop is in the loading position of FIG. 1. Thus, forward in FIG. 1 is to the right. In addition, other terms used herein that relate to orientations or directions, such as downward, backward, etc., should be given their ordinary meaning not inconsistent with the above defined terms.

The frame and other parts of the collection device may be constructed of various rigid, lightweight materials and products, such as for example aluminum tubing joined together with rivets or welds, wood rods connected together by metal brackets and screws, or molded plastic. By way of example, one commercially available material suitable for components such as receptacle 3 and cup 13 is a moldable thermoplastic acrylic polyvinyl chloride sold under the trade name Kydex, by KYDEX LLC of Bloomberg Pa. The particular cross-section shapes, sizes, thicknesses, and material selections may vary from one portion of the device to another as needed to achieve an optimal combination of strength, weight, and functionality. For example, the handle 2 may comprise a relatively rigid plastic material that is stiffer than another more flexible plastic material used for the receptacle 3.

Collecting waste material with the waste collection device involves generally two actions: scooping the waste material into the cup 13; and dispensing the material from the cup into the receptacle 3. In order to initiate the process, the collection device must first be in the "scooping", or "loading" position as depicted in FIG. 1 wherein scoop 4 is pivoted all the way down, extending from the frame 2 in a direction generally away from grip end 6. The collection process begins by holding the device at grip end 6, with the open end of cup 13 close to, or touching the ground immediately behind the waste material to be collected. From this position the scoop is moved forward, toward the waste material, and slid quickly underneath it in one motion, scooping the material into the cup 13. If the waste material is on a soft surface such as grass, it may facilitate scooping to press the cup slightly downward into the surface while scooping.

Once the scooping action is completed and the waste material is entirely inside the cup 13, the waste material can be dispensed into the waste receptacle 3. Dispensing involves rotating the scoop 4 about pivot 14 until it reaches the dispensing position shown in FIG. 3. Rotation of the scoop may be effected either by hand, or by an actuation mechanism built into the collection device. The rotation is best done in one continuous motion such that the waste material tends to stay seated in the cup under centrifugal force until the cup reaches the receptacle, at which point the rotation is abruptly halted. The rotation may be halted manually, or by the scoop encountering a physical stop such as for example a bumper (not shown) on frame 2 in the path of scoop arm 12. When the scoop stops, inertia causes the waste material to slide out of the cup and directly into the receptacle 3. The scoop can then be rotated back down to the loading position, and the process repeated.

Although the waste collection device may be effectively used to scoop waste off the ground and into the cup 13 in the above described manner, the present invention contemplates and may incorporate the use of a spade or rake of the type associated with prior art dust pan and rake refuse collectors to assist with the scooping step. Advantageously the waste collection device of the present invention is intended to be operated using only one hand. The operator's other hand is therefore available should the need arise, for whatever reason, to use a spade or similar tool to help push the waste material into the scoop. Such a pushing tool could be detachably connected to the frame for easy access only when needed.

Figure 6:
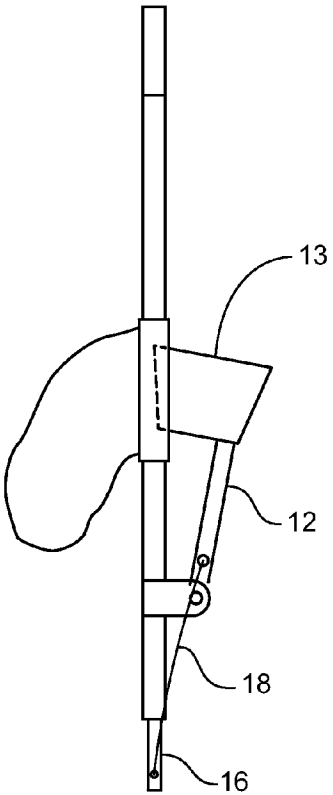
FIGS. 4 through 6 illustrate another embodiment of a waste collection device with an actuating mechanism in the form of a telescoping drive member and a rigid link.
Figure 5:
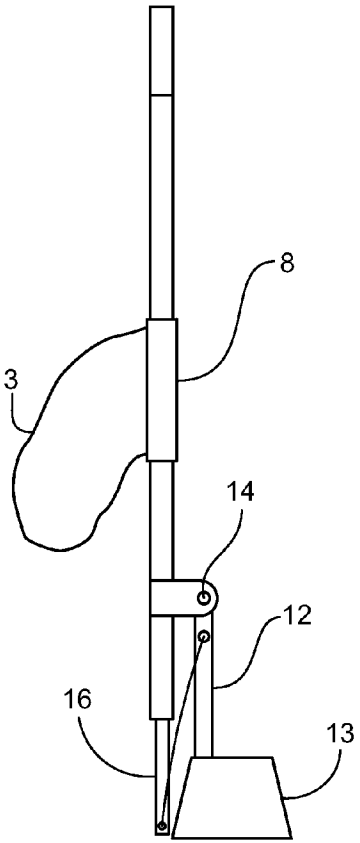
Figure 4:
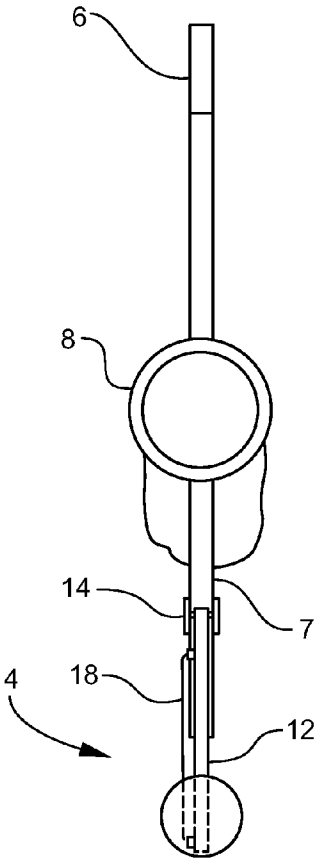

FIGS. 4 through 6 illustrate an exemplary waste collection device that incorporates an actuating mechanism for rotating the scoop from the loading position to the dispensing position. The depicted actuating mechanism comprises a drive member 16 telescopically extending from the lower end of lower frame portion 7, and an actuating link 18 extending from the lower end of drive member 16 to scoop arm 12 near pivot joint 14. Link 18 may simply comprise a rigid metal rod inserted through holes in drive member 16 and arm 12. The drive member 16 and link 18 are configured such that the end of the drive member is roughly even with the bottom edge of the cup 13 when the scoop is pivoted all the way down to the loading position.

FIGS. 4 and 5 show the waste collector in the loading position, with the drive member fully extended from the bottom of lower frame portion 7, and the upper end of link 18 pivotally connected to scoop arm 12 slightly below pivot joint 14. From this position, with the end of the drive member 16 touching the ground, the scoop 4 can be rotated toward the dispensing position by pushing down on the grip end 6 of frame 2, thus forcing the drive member 16 into the lower end of lower frame portion 7. A resulting offset force is applied by link 18 to the scoop arm 12, causing the scoop 4 to pivot upwards about the pivot joint 14. The scoop rotation is again abruptly halted at the dispensing position, shown in FIG. 6, by a suitable stop or bumper, ejecting the waste material into receptacle 3. Gravity will cause the scoop to swing back down to the scooping position of FIG. 4 by simply releasing the downward pressure on the grip. Although not shown with this particular embodiment, the actuating mechanism may include a return spring configured to bias the scoop toward the loading position. Various configurations of return springs are possible, such as for example a torsion spring about pivot joint 14 tending to rotate shovel arm 12 downward, or a compression spring in lower frame portion 7 tending to push drive member 16 downward out of lower frame portion 7.

Figure 7:
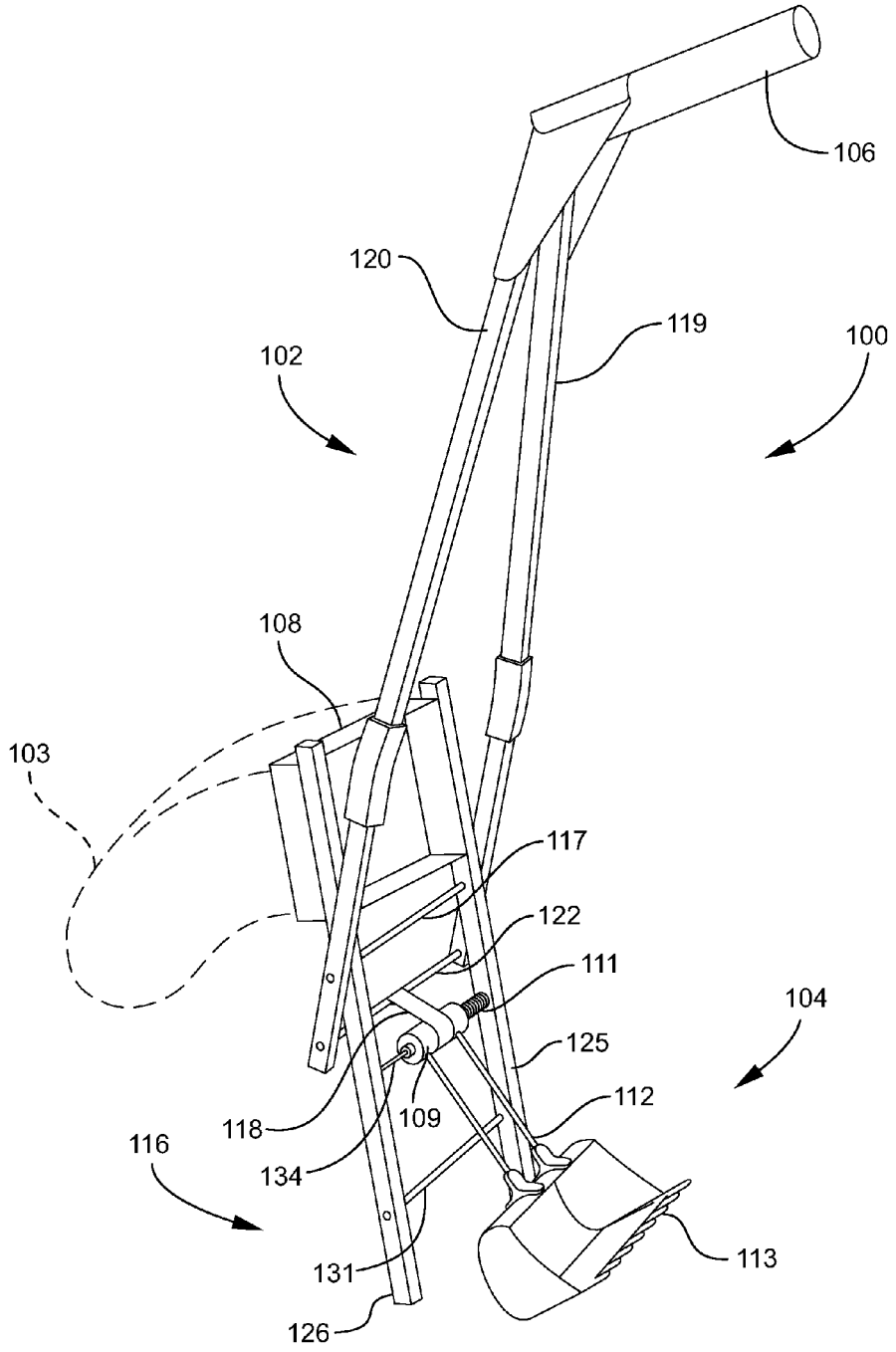
FIG. 7 is a perspective view of another embodiment of the waste collection device incorporating an actuating device comprising a pivoting drive member and a flexible link connected to a scoop.

Another exemplary embodiment of a waste collector incorporating a rotation actuation mechanism is depicted in FIG. 7 and indicated generally at reference numeral 100. The waste collector 100 comprises generally a frame 102 with a grip end 106, a drive member 116 pivotally connected to the frame 102, a scoop 104 pivotally connected to the drive member 116, an actuating link 118 connected between the frame 102 and the scoop 104, and a return spring 111. The link 118 may be in the form of an inextensible cord, such as a steel cable, a nylon strap, or the like. The frame 102 may be bifurcated as shown with right and left side frame members 119 and 120 extending downward from grip end 106 to a frame pivot rod 117 that pivotally connects frame 102 and drive member 116. Frame sides 119 and 120 extend below the frame pivot rod 117 to a rigid cross member 122 connecting the two sides. The drive member 116 comprises left and right side legs 125 and 126 that fit between the frame side members 119, 120, and extend above and below the frame pivot rod 117. The upper ends of drive member legs 125, 126 are connected by a structural opening 108 for supporting a waste receptacle 103, and the lower ends are rigidly connected by a cross member 131. A scoop pivot rod 134 connects the legs 125 and 126 at a point below frame pivot rod 117.

The scoop 104 comprises a shovel 113, a hub 109 mounted for rotation about scoop pivot rod 134, and a pair of scoop arms 112 connecting the shovel 113 to the hub 109. A return spring 111 is disposed about the pivot rod 134, and configured to apply a torque tending to rotate the scoop downward toward the ground. The link 118 is connected to and wrapped around hub 109 at one end as shown, and fixed at the other end to cross member 122 of frame 102. Rotation downward of the scoop thus winds the link 118 around hub 109, causing the strap to pull the hub 109 and drive member 116 toward the lower end of frame 102. In doing so, the drive member 116 also pivots relative to frame 102 about pivot rod 117, thereby reducing the angle between the frame and drive member. The scoop 104 will swing downward until reaching the scooping/loading position, defined by the scoop arms 112 contacting the lower frame cross member 131, or by cross member 122 of frame 102 contacting the drive member legs 125, 126.

With the scoop in the loading position, the waste collector 100 can then be used to scoop waste material off the ground and into the shovel 113 using the same continuous scooping motion described with respect to the previous embodiment, followed by downward handle pressure as previously described to initiate the upward rotation of the scoop. In this case the downward pressure creates a moment between the drive member 116 and frame 102, which causes the drive member 116 to pivot about rod 117 and tilt back relative to frame 102, increasing the angle between the drive member and frame. As a consequence, cross member 122 of the frame 102 moves away from the hub 109, unspooling the link 118 from the hub 109 and rotating the scoop upward. When properly configured, only moderate downward pressure is required to create a moment sufficient to overcome the return spring bias and rotate the scoop upward and around to the dispensing position proximate the structural opening 108 at the upper end of drive member 116. In the same manner as previously described, scoop rotation is stopped by the scoop contacting some portion of drive member 116 or structural opening 108, ejecting the waste material from shovel 113 into the receptacle 103.

Figure 8:
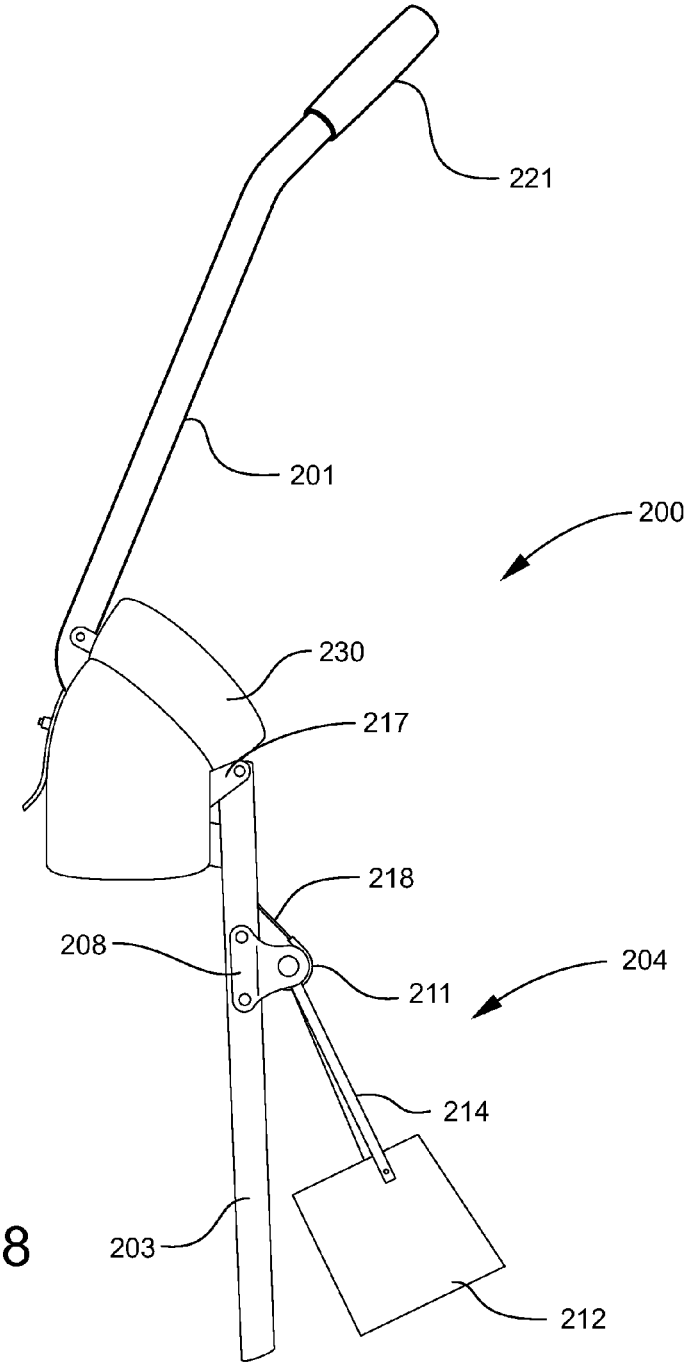
FIG. 8 is a side view of another embodiment of the waste collection device with a pivoting drive member and a flexible link connected to a scoop.
Figure 9:
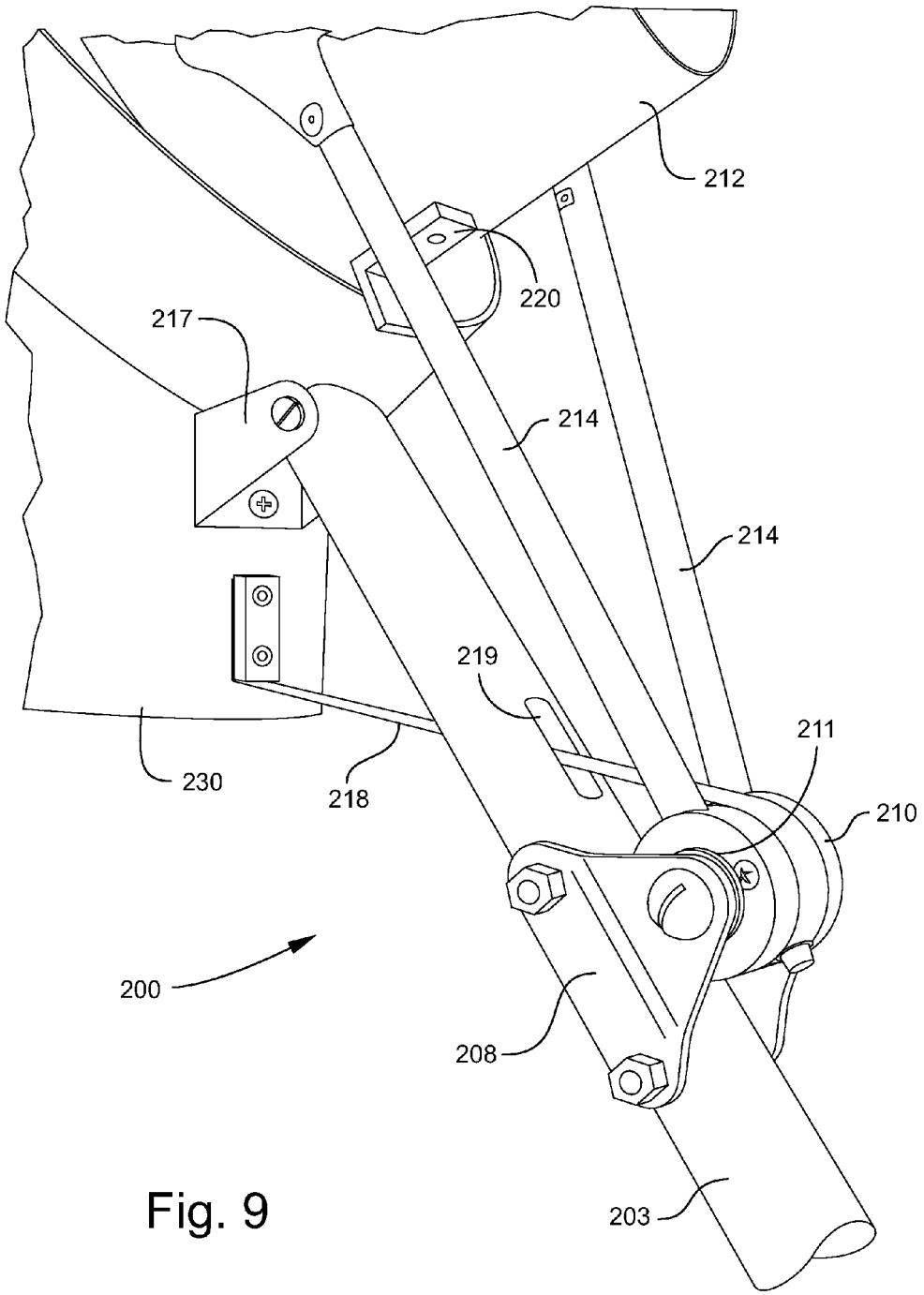
FIG. 9 is a close-up perspective view of the actuating mechanism of the embodiment of FIG. 8.

Another exemplary embodiment of the waste collection device is depicted in FIGS. 8 and 9, and indicated generally at reference numeral 200. The waste collector 200 comprises a frame in the form of a handle 201 with a grip end 221, a structural opening 230 connected to or integral with the other end of the handle 201, a drive member 203 pivotally connected to the structural opening 230, a scoop 204 pivotally connected to the drive member 203, an actuating link again in the form of an inextensible pull strap 218 connected between the structural opening 230 and the scoop 204, and a return spring 211. A flange 217 extending from the front side of the structural opening 230 pivotally supports the upper end of drive member 203. The flange 217 is positioned and oriented relative to the structural opening 230 and handle 201 to allow the drive member 203 to swing in the same plane as the handle. Like handle 201, the drive member 203 may also be a single rod or tube made of a rigid, lightweight material such as for example metal or plastic tubing.

A scoop 204 similar to the previously described scoops is mounted for rotation to the drive member 203, and comprises a scooping surface in the form of an open cup 212, a hub 210, and a pair of scoop arms 214 connecting the hub and cup. The scoop is pivoted off the front side of the drive member 203 by scoop bracket 208, and swings in the same plane as the drive member 203. In addition, scoop bracket 208 is positioned so that the open end of cup 212 aligns with and faces the top of the structural opening 230 when the scoop is rotated all the way up to the dispensing position. The return spring 211 is a coil torsion spring disposed between the hub 210 and the scoop bracket 208, and installed in a partially wound or unwound condition such that it applies a rotational bias to the hub 212 tending to rotate the scoop 204 downward toward the loading position.

FIG. 9 is a close up view of the actuating mechanism with the scoop 204 in the dispensing position. One end of the strap 218 is connected to the hub 210 and generally centered side-to-side, wrapping at least partially around the hub. The other end of the strap is connected to the frame, and more specifically structural opening 230 in this embodiment, substantially below flange 217. Strap 218 passes through a slot 219 in drive member 203 sized to allow the drive member to swing freely without interfering with the strap. Alternatively the upper portion of the drive member 203 could be an open structure of two side-by-side members, such as rods or flat beams, with the strap 218 passing between.

Operating the waste collector of the present embodiment is essentially the same as described above with reference to the embodiment of FIG. 7. Waste material is initially scooped off the ground and into the cup 212 by sliding the cup along the ground toward the waste material with one continuous scooping motion, followed by downward pressure to initiate the upward rotation of the scoop. The downward pressure causes drive member 203 to pivot about pivot flange 217, increasing the angle between the drive member 203 and handle 201, and increasing the distance between the structural opening 230 and the scoop hub 210. Consequently strap 218 is pulled from the hub 210, rotating the scoop 204 upward. A stop or bumper, indicated at reference numeral 220, is again employed to stop the rotation of the cup on reaching the structural opening, and eject the waste material into the structural opening and receptacle. Releasing downward pressure on the handle allows the return spring 211 to rotate the scoop 204 in the reverse direction, back down to the loading position.

Figure 11:
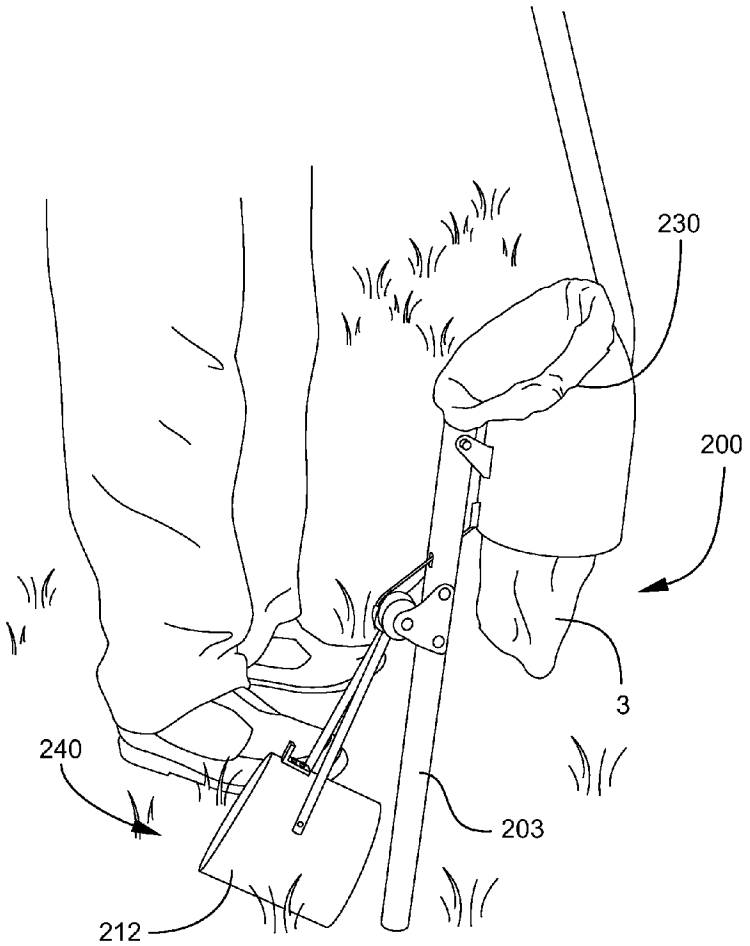
FIGS. 10 through 13 illustrate discrete points in an exemplary process of using the waste collection device of FIG. 8 to scoop up an object, and deposit the object in a receptacle portion of the device.
Figure 10:
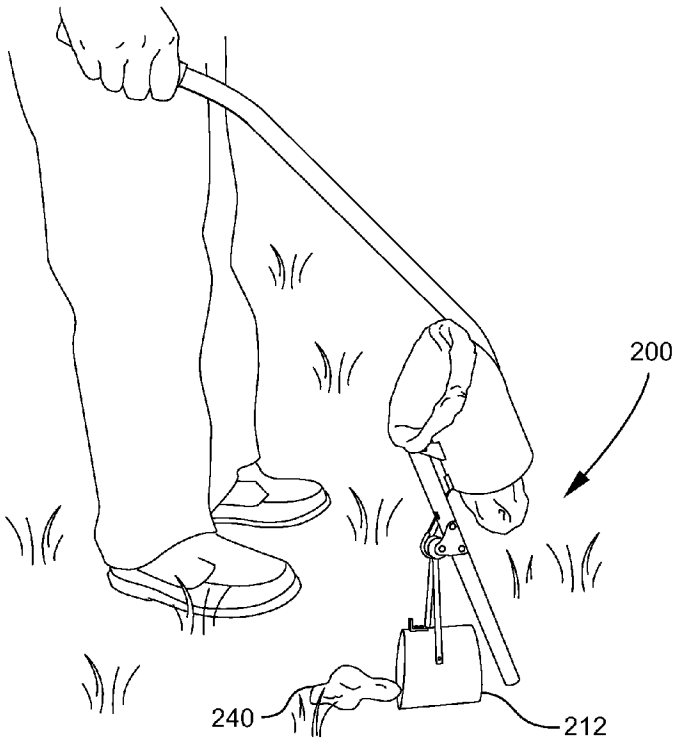
Figure 13:
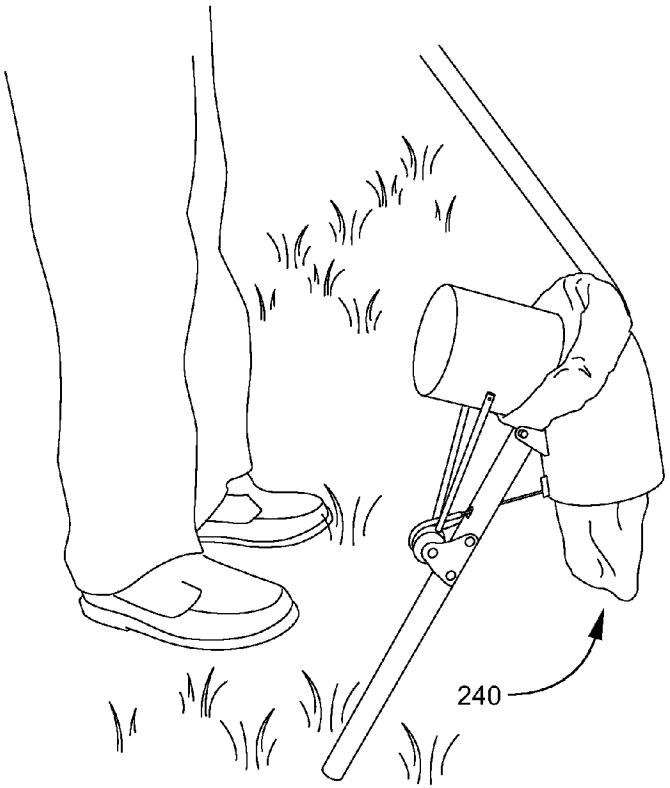
Figure 12:
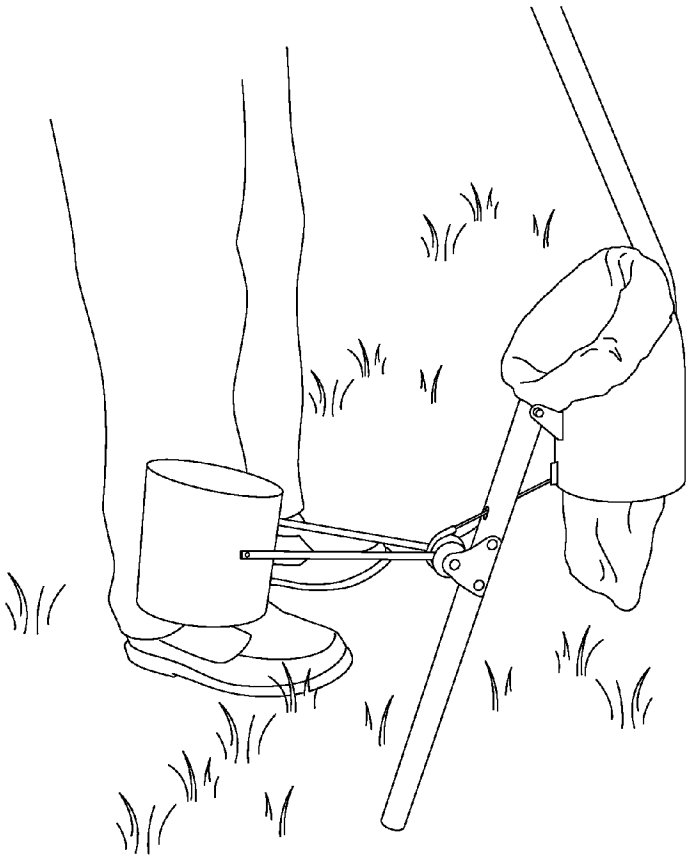

FIGS. 10-13 depict the present embodiment of the waste collection device at four discrete points in the above described scooping and dispensing process. Namely, in FIG. 10 the waste collector is positioned for scooping a waste material deposit 240, with cup 212 touching the ground directly behind and facing the waste deposit. Deposit 240 may be animal excrement, or any other waste or trash material. In FIG. 11 the waste material deposit is in the cup 212 and not visible, and the waste collector is in a substantially vertical orientation with end of drive member 203 touching the ground. This is the starting position, from which the dispensing motion can be initiated by the operator simply applying downward pressure on grip end 221 of handle 201. FIG. 12 shows the scoop 204 at approximately the mid-point of rotation from the scooping position to the dispensing position. In FIG. 13 the scoop 204 has completed the upward rotation, cup 212 is at the dispensing position, and the waste material deposit 240 is in the waste receptacle. As previously noted, the waste deposit will tend to stay seated in cup 212 while the cup swings upward if a continuous downward handle pressure is maintained from the starting position of FIG. 11 to the dispensing position of FIG. 13.

Figure 14:
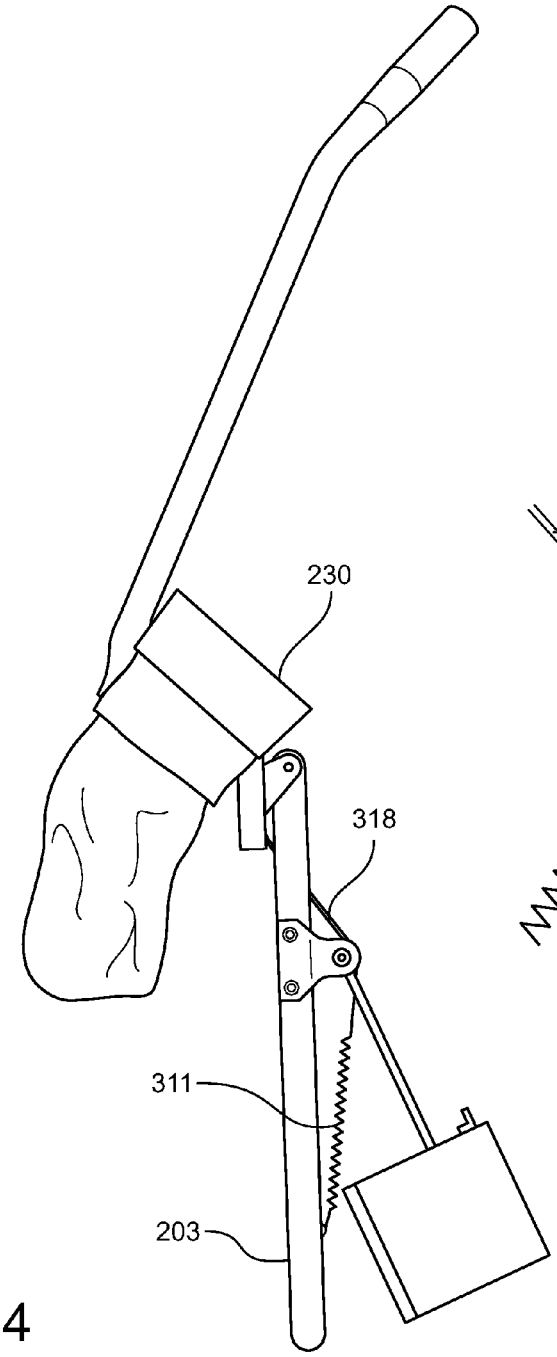
FIG. 14 is a side view of the embodiment of FIG. 8 that further incorporates an extension type return spring.
Figure 15:
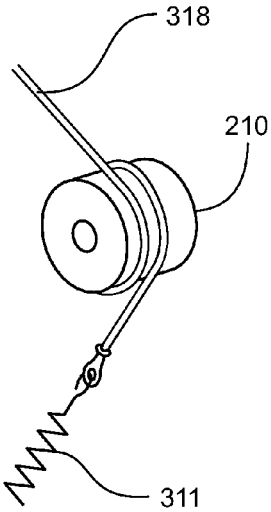
FIG. 15 is a detail of the scoop hub portion of the waste collection embodiment of FIG. 14.

FIGS. 14 and 15 depict a variation of the waste collector embodiment of FIGS. 8 through 13 that uses a different return spring arrangement. In particular, the coil, torsion type return spring 211 is replaced by an extension spring 311. As in the previous embodiment, a strap or cord 318 extends from a fixed point on the frame or structural opening 230 below the pivot point of drive member 203, to scoop hub 210, passing over and around the front of hub 210. However instead of terminating on hub 210, cord 318 continues all the way around hub 210 at least once, passing by itself and exiting in the downward direction shown. The downward extending free end is attached to one end of the extension spring 311 below hub 210. The other end of spring 311 is connected under tension to a relatively lower portion of the drive member 203. The tension in the extension spring thus biases the scoop to rotate downward and the drive member 203 to pivot down to the scooping position.

It should be appreciated that the extension spring 311 could alternatively extend upward and connect to drive member 203 above the location of hub 210 instead of below it. In that case the strap would exit the hub from the back side instead of the front, and connect to the lower end of the upward extending tension spring. The tension in the spring would again tend to bias the scoop to rotate downward toward the loading position.

Figure 16:
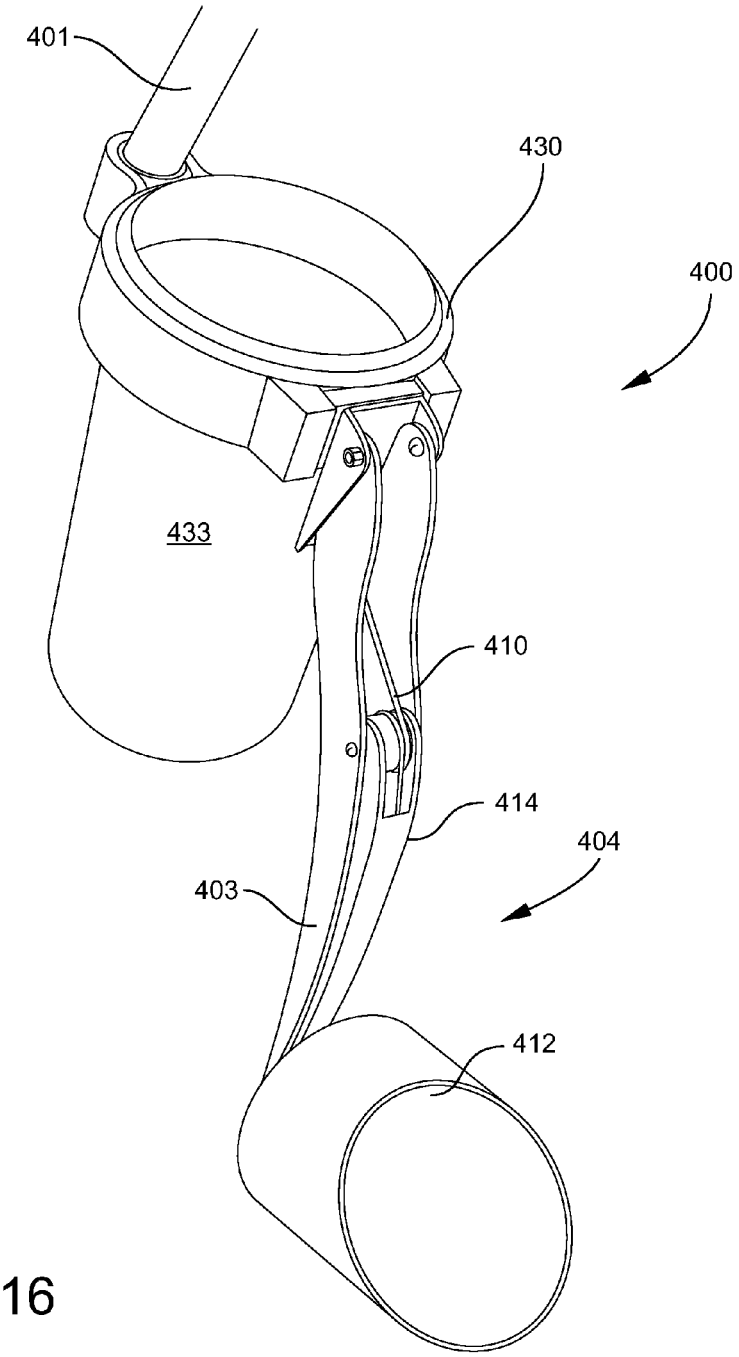
FIGS. 16 and 17 are perspective views of another embodiment of a waste collection device with a pivoting drive member and extension type return spring, and wherein the receptacle comprises a detachable canister supported by a structural opening.
Figure 17:
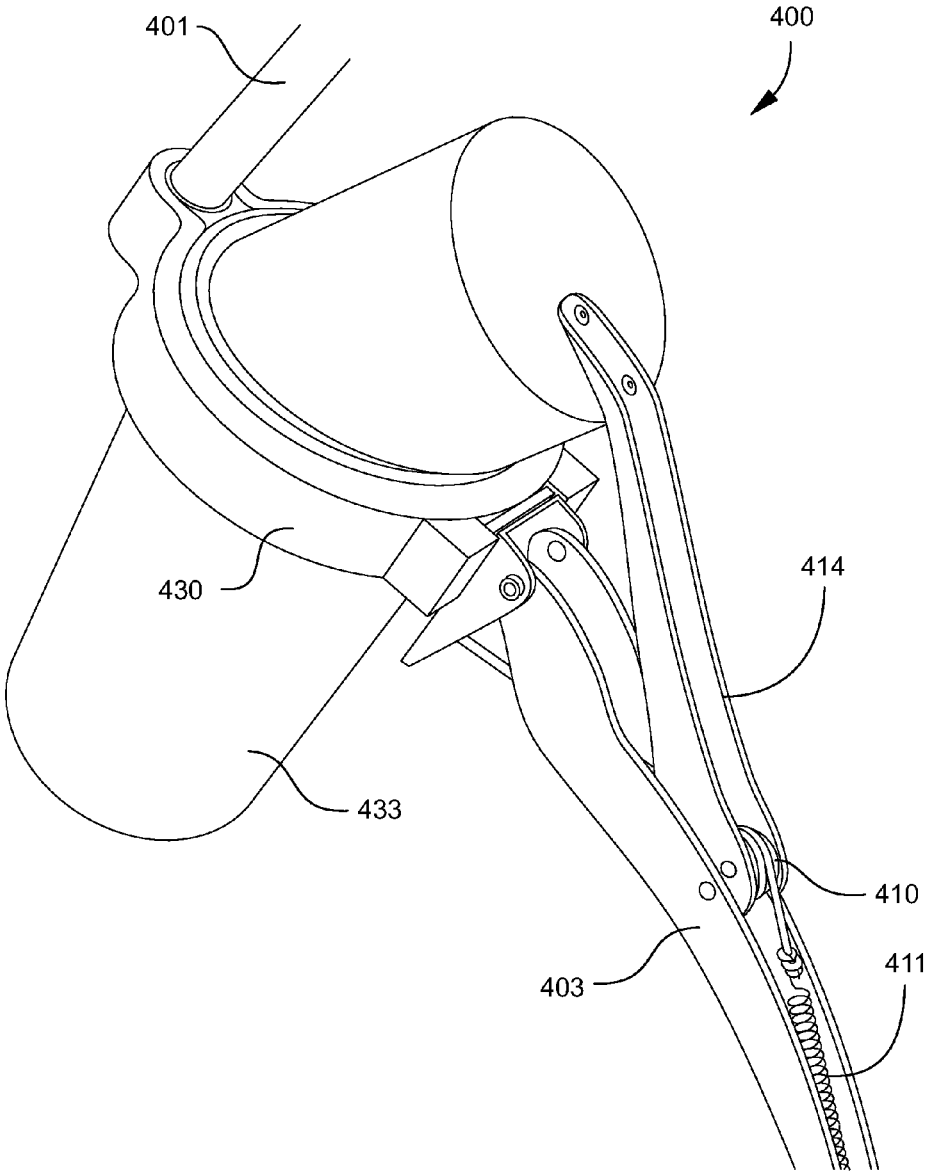

Another embodiment of the waste collection device of the present disclosure is shown in FIGS. 16 through 19, and indicated generally at reference numeral 400. In FIGS. 16 and 17 the waste collection device 400 is shown in the loading and dispensing positions respectively. Similar to the waste collection device embodiment 200 described above, waste collection device 400 comprises a handle 401 connected to the back of a structural opening 430, a drive member 403 pivotally connected to the front of the structural opening 430, and a scoop 404 pivotally connected to the front of the drive member 403. The scoop 404 comprises a cup 412 and a single, channel shaped scoop arm 414, open on the back side, and extending from the cup 412 to the scoop hub 410. The drive member 403 similarly comprises a channel-like structure open on the front side, and sized to accept the scoop hub 410 and scoop arm 414 as shown in the figures. The return spring configuration is like that of the collection device embodiment of FIG. 14, i.e. comprising a downward extending extension spring 411 connecting to a lower portion of the drive member 403. As can be seen in FIG. 16, when the scoop is in the loading position, the spring 411 is trapped between the scoop arm 414 and drive member 403 and thus hidden from view.

Figure 18:
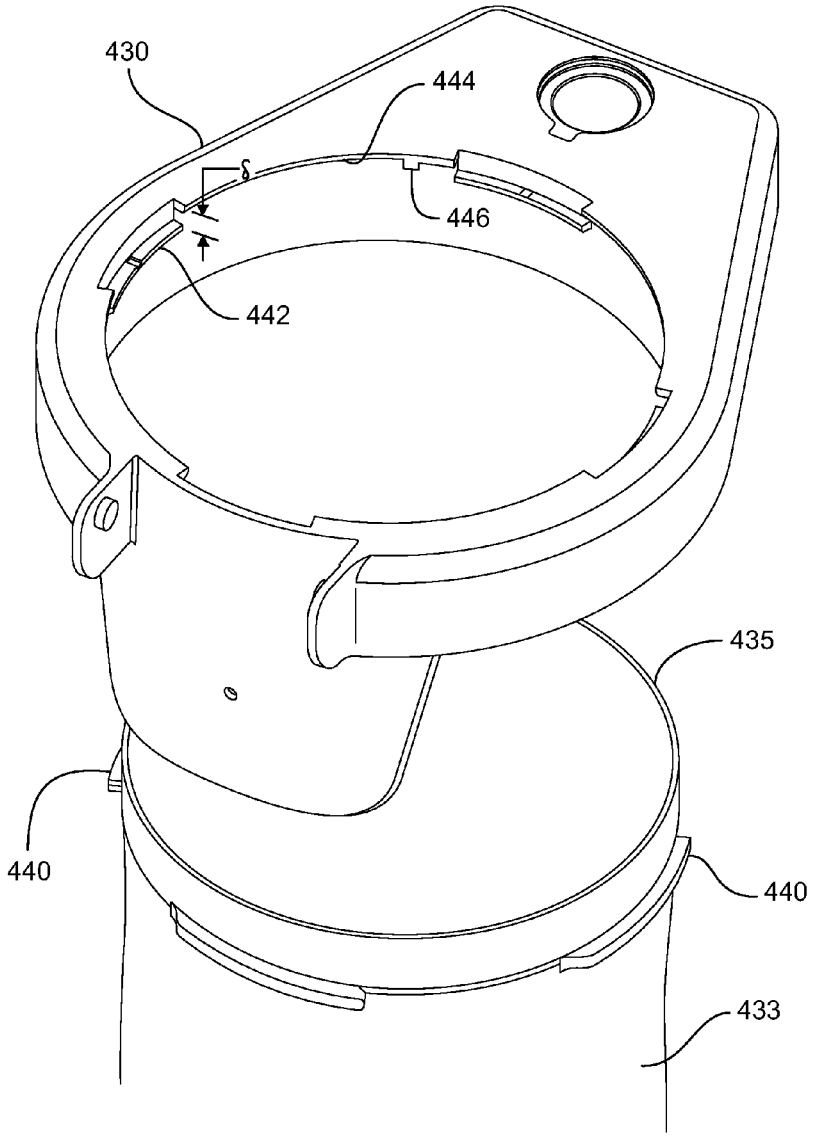
FIGS. 18 and 19 are exploded and cut-away views respectively of the structural opening and top portion of the detachable receptacle of the waste collection device of FIG. 17 showing the receptacle attachment features.

Waste collection device 400 further comprises a detachable waste receptacle 433. FIG. 18 is an exploded view of the structural opening 430 and waste receptacle 433 showing the tab and slot (or "bayonet") arrangement for capturing the waste receptacle. In particular, a series of symmetrical spaced apart, elongated tabs 440 project out from the side of receptacle 433 somewhat below the top edge 435 thereof. The farther down the tabs are from the top edge of the receptacle, the more of the receptacle will project above the structural opening 430 once attached. Structural opening 430 includes a corresponding number of symmetrical, spaced apart, inward facing shelves 442 below the top rim 444 of the opening. The shelves are positioned such that a gap 'δ' between the top of each shelf 442 and the bottom of rim 444 is slightly greater than the thickness of tabs 440.

Figure 19:
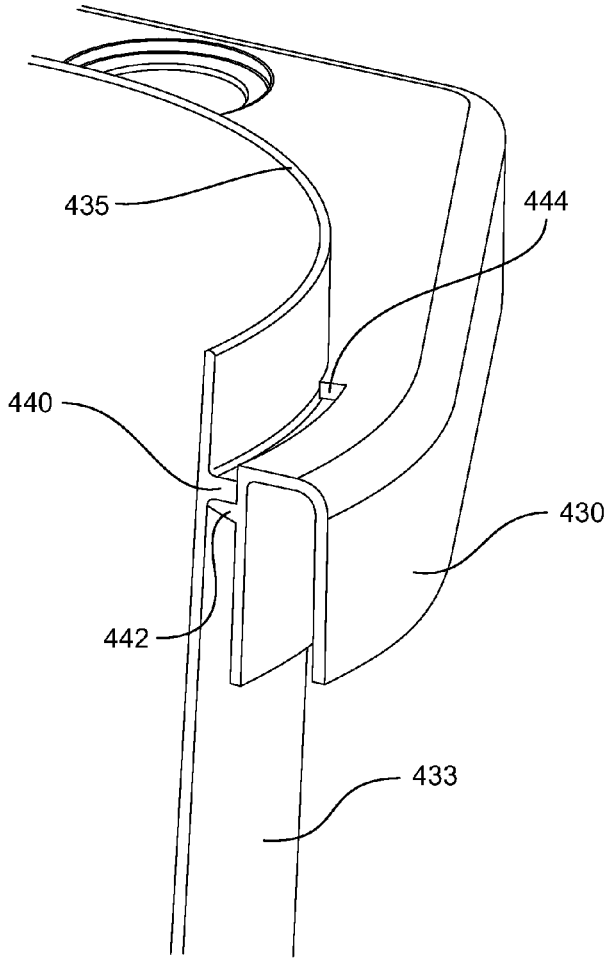

The receptacle 433 is attached to the structural opening 430 from underneath. The top portion of the receptacle is first pushed upward through rim 444 until the tabs 440 bottom out against the underside of rim 444. If the tabs initially contact the shelves 442 instead of rim 444, the receptacle may be rotated until the tabs 440 align with the spaces between shelves, thus allowing the receptacle and tabs to move up to the rim 444. Then with the tabs held against the underside of rim 444, the receptacle is twisted, forcing the tabs between shelves 442 and rim 444, and trapping the tabs in the structural opening 430. FIG. 19 is a cutaway close-up view showing a tab 440 of receptacle 433 trapped between a shelf 442 and the rim 444 of structural opening 430. The tabs 440 may be longer than shelves 442 to ensure that both ends of tabs 440 extend under rim 444 when in the locked position, and stops 446 added to prevent over-rotation. The shelves 442 or tabs 440 may further include a detent feature to help retain the tabs in the locked position. Unlocking and removing the waste receptacle from the structural opening is accomplished by first twisting in the opposite direction until the tabs 440 are clear of shelves 442, and then pulling the receptacle straight down.

The detachable receptacle 433 of waste collector 400 may also be used in conjunction with disposable liner, such as a plastic bag. For example, a plastic bag, such as the ubiquitous bags used for sanitary hand collection of dog feces, can be placed inside the receptacle prior to attaching the receptacle to the waste collector. If the bag is deeper than the receptacle, the excess can be folded down around the outside of the receptacle. The receptacle is then attached to the structural opening 430 in the above described manner, trapping any excess portion of the bag between the receptacle and structural opening. In this manner the portion of the receptacle that projects above structural opening 430 is completely covered by the plastic bag, ensuring that no waste material touches the receptacle during use, or when removing the receptacle from the waste collector. After use, the lined receptacle may be detached, and the bag pulled out of the receptacle by the clean, open end, for disposal.

It should be appreciated that the above described tab and slot configuration is exemplary, and that various other receptacle attachment schemes may be effectively employed for detachably connecting a receptacle to the frame or structural opening. For example, the receptacle could attach to the structural ring with screw threads in the same manner that a screw-on lid attaches to a jar. Alternatively the receptacle could have a lip around the rim that allows it to simply hang from the structural opening when inserted downward through the structural opening from the top. In addition, any variety of fasteners, such as snaps, buckles, buttons, threaded connectors, hook and loop material, and the like may be adapted for detachably connecting the receptacle to the frame or structural opening.

Figure 20:
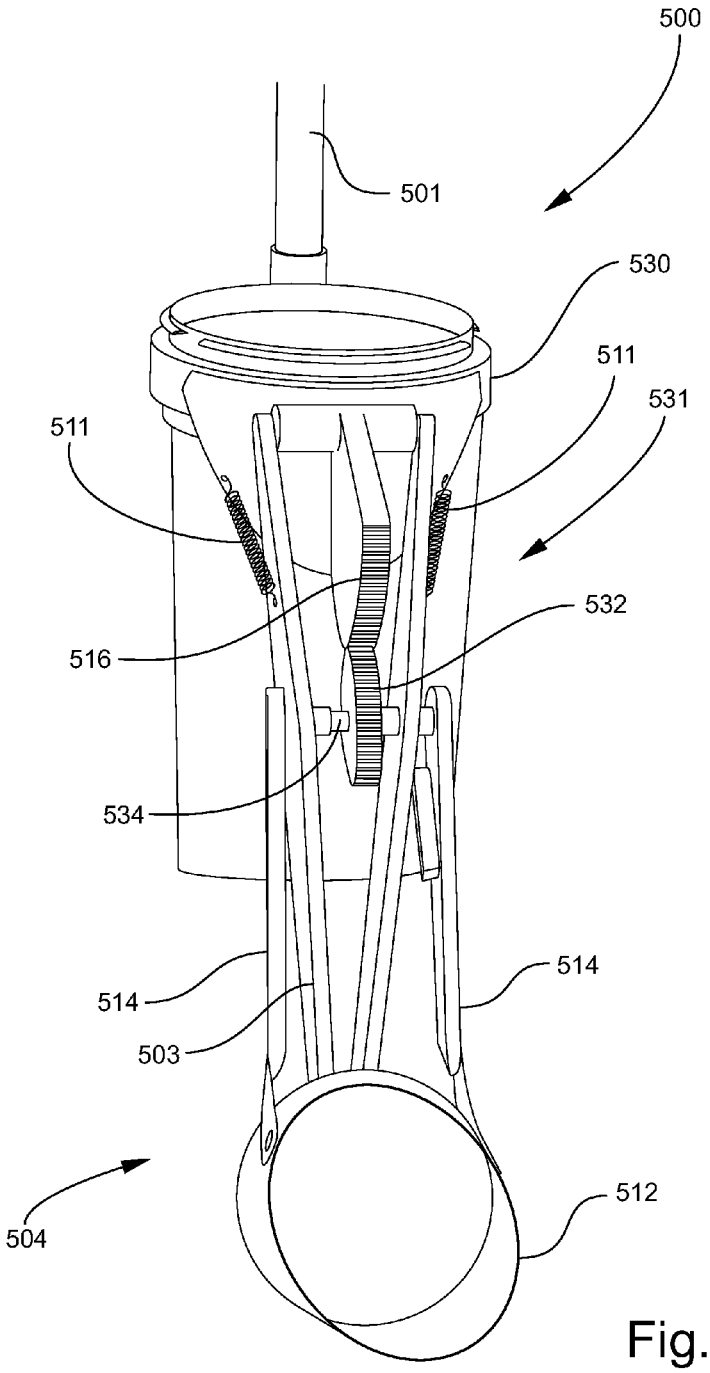
FIG. 20 is a front perspective view of another embodiment of the waste collection device with a gear drive actuating mechanism.

Another embodiment of the waste collection device is shown in FIG. 20, and indicated generally at reference numeral 500. Waste collection device 500 comprises a handle 501 connected to the back of a structural opening 530, a two-sided drive member 503 pivotally connected to the front of the structural opening 530, and a scoop 504 pivotally connected to the drive member 503. However, instead of a push rod or pull strap, the actuating link of the present embodiment is in the form of a gear drive system 531 comprising a fixed gear 516 and a scoop hub gear 532. The scoop hub gear 532 is rigidly attached to a scoop axle 534 that extends between scoop arms 514, and is rotationally disposed in drive member 503. The hub gear 532, axle 534, scoop arms 514, and cup 512 form one rigid or integral member, such that rotation of the hub gear 532 causes the scoop arms to rotate, and vice-versa. The fixed gear 516 extends forward from the front of the structural opening 530 between the two sides of drive member 503. The position and curvature of the fixed gear 516 are selected such that the hub gear 532 stays exactly meshed with the fixed gear as the drive member 503 pivots up or down. Thus, moving the drive member 503 causes hub gear 532 to roll along fixed gear 516, which in turn rotates the scoop 504 up or down. A pair of extension type return springs 511 extending from structural member 503 to each side of drive member 503 pull the drive member toward the structural opening and receptacle, continually biasing the drive member and scoop toward the loading position.

The act of dispensing collected waste material using the gear drive embodiment is fundamentally the same as described above for the previous embodiments. The operator pushes down on the handle 501 with drive member 503 touching the ground, causing the drive member to pivot away from the receptacle while the handle and receptacle move slightly toward the ground. As the drive member pivots upward, the hub gear 532 is rotated by the fixed gear 516, swinging the scoop up to the dispensing position. When downward handle pressure is released, springs 511 pull the drive member back down, which causes the hub gear and scoop to rotate back to the loading position.

Figure 21:
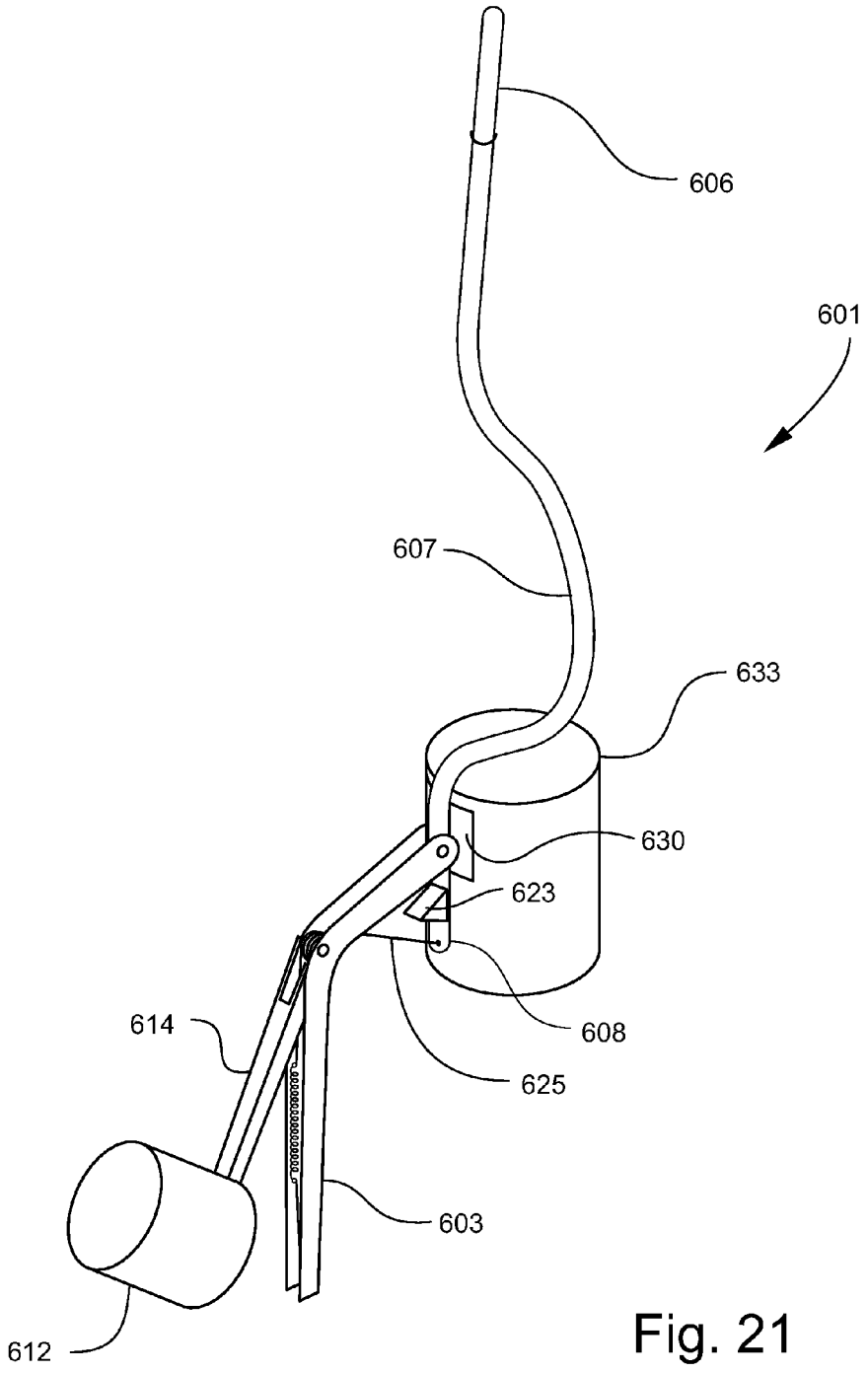
FIG. 21 is a perspective view of another exemplary embodiment of the waste collection device wherein the drive member is pivotally connected to the handle.

FIG. 21 depicts another embodiment of the waste collection device that, unlike several of the previously described embodiments, does not have a structural opening between the handle and the drive member. In particular, waste collection device 600 comprises a handle 601 with a grip end 606, a bowed section 607, and an extended lower portion 608. The bowed section 607 projects in a sideways direction to provide clearance for the cup during dispensing, as will be described further below. A drive member 603 is pivotally connected to the front of the lower portion 608 of frame 601, below the bowed section 607. Drive member 603 may have a curved or angular shape as shown, extending initially outward from handle 601, and transitioning to a generally downward, vertical orientation. The lower portion 608 of handle 601 may include a stop 623 to limit the downward rotation of drive member 603. Device 600 further comprises a scoop 614, and a cable/spring actuation arrangement configured substantially like that of the embodiments described previously in reference to FIGS. 14 through 17. Notably however in the present embodiment the actuating cable 625 is attached to the handle 601 rather than to a structural opening. Additionally, a receptacle 633 is mounted to the back of the lower portion 608 of handle 601, rather than to a structural opening.

The waste receptacle 633 may be permanently attached to the handle such as with rivets or bolts, or detachably connected with any type of simple fixture. Fixtures for detachable connection could include, for example, a tab on the receptacle received by a slot in a bracket attached to the handle, conventional snaps, hook and loop strips, or any other simple and secure method. FIGS. 22*a* and 22*b* depict one such exemplary detachable arrangement comprising a bracket 630 attached to the back of handle 601, with T-shaped posts 634 projecting from the back of the bracket. The posts 634 are received by keyhole slots 635 in a flange 636 on the front of the receptacle 633. As can be seen, the receptacle may be attached by pushing the flange 636 and slots 635 onto, and then down around posts 634 such that the heads of the posts trap the flange against the bracket 630 and hold the receptacle 633 to the handle 601. Slots 635 may include a detent feature, such as a small bump, to help secure the receptacle during use.

FIG. 22*c* depicts an alternative configuration of a bracket 630 with a tapered pocket shape for receiving and trapping a tapered version of a flange 636. The taper prevents the flange and receptacle from slipping out, similar to the T-posts and slot of FIGS. 22*a,b*. A detent feature may be included in this embodiment as well, such as one or more small bumps on bracket 630 that align with depressions or holes on the flange 636.

Figure 23:
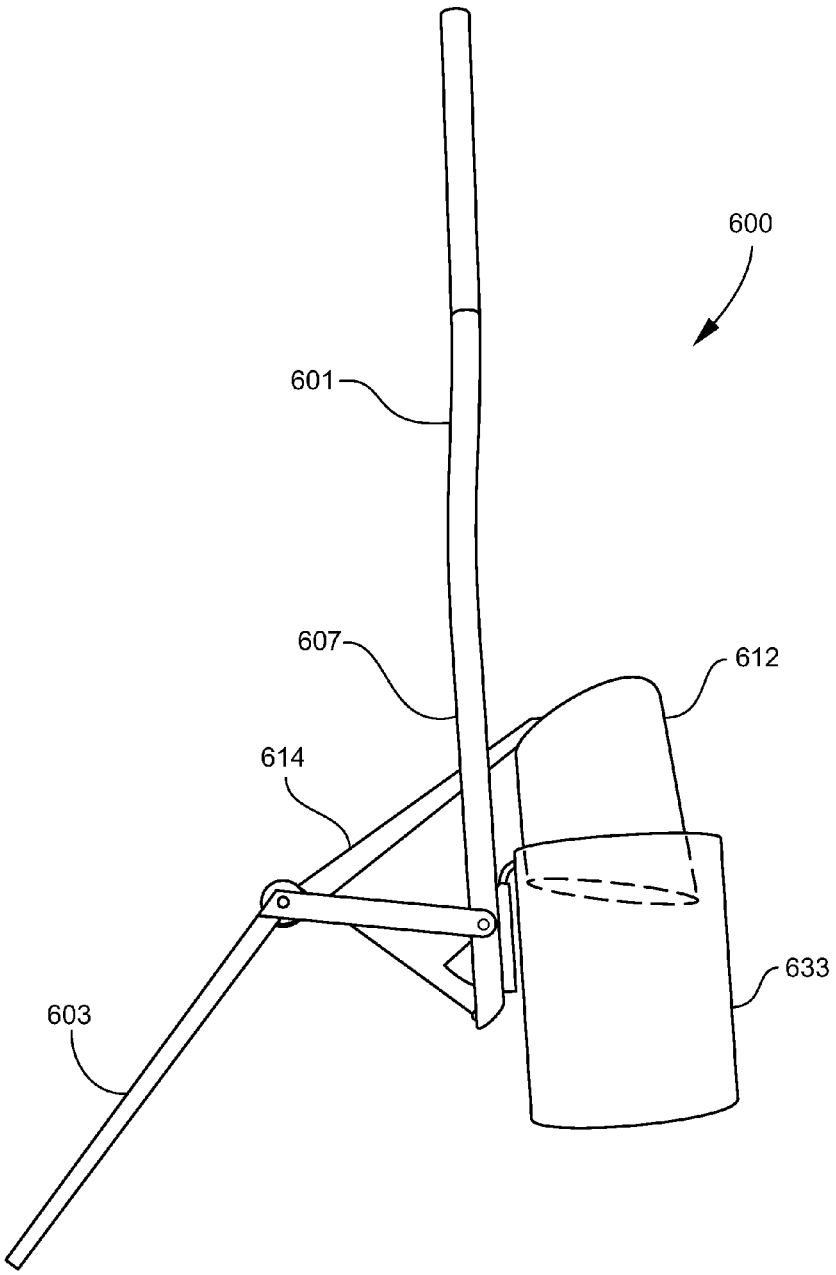
FIG. 23 is a side view of the waste collection device of FIG. 21 shown in the dispensing position.
Figure 24:
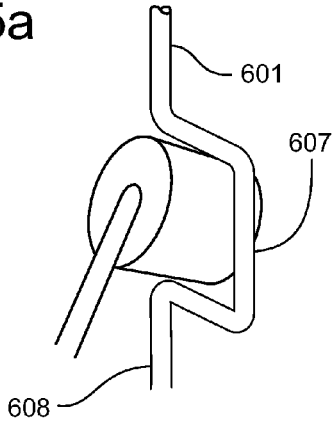
FIG. 24 illustrates another embodiment of the handle portion of the waste collection device of FIG. 21.

FIG. 23 illustrates the waste collection device 600 in the dispensing position, with the cup 612 facing down inside the top of receptacle 633. The scooping and dispensing process operates in the same manner described in reference to the previous embodiments, however in the present embodiment the cup must pass by the handle 601 in order to reach the receptacle 633. It should be appreciated that were the handle a straight member extending from the lower portion 608 to the grip end 606, the handle would be directly in the path of the scoop cup as it swings up to the dispensing position. Accordingly, the handle is configured such that it bows out to one side by an amount sufficient to allow the cup to pass by without interference. The exact shape of the bowed section 607 is not critical, and it can be generally curved as shown in FIG. 21, or more angular such as the alternative embodiment shown in FIG. 24.

Although the actuating mechanisms of the above described embodiments have all involved the application of downward pressure on the handle to create movement in a drive member, other variations or embodiments are possible. For example, any of the above described embodiments could be operated without any portion of the device touching the ground by simply grasping and moving the drive member by hand. In such an embodiment a handle or grip could be incorporated to facilitate the direct manual operation. Alternatively, an actuating mechanism could be operated using a rod or cable attached to a trigger lever. Moreover, instead of manual force, an alternative power source such as a wound spring or electric motor could be employed to provide the force and motion required for actuation. For example, a strong spring could be used to produce a rapid dispensing motion, after which the scoop, or scoop and drive member could be re-cocked, either by hand or using an electric motor.

Figure 25A:
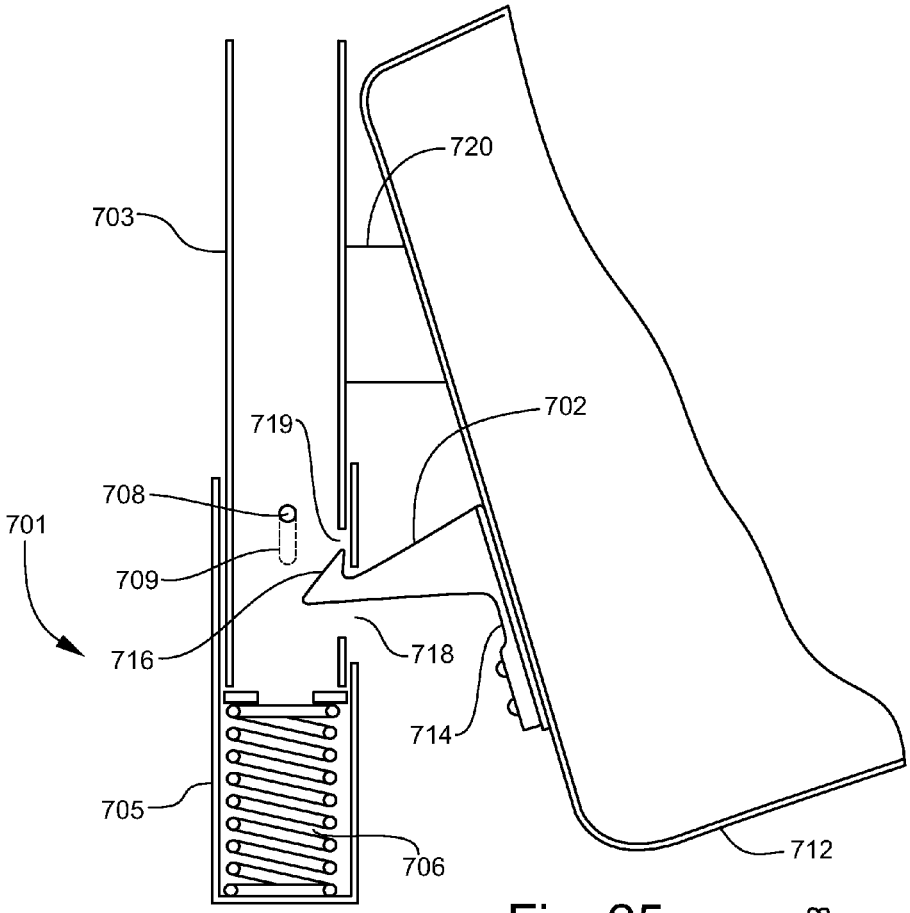
FIGS. 25*a* and 25*b* depict an exemplary automatic latch for holding the scoop in the loading position.
Figure 25B:
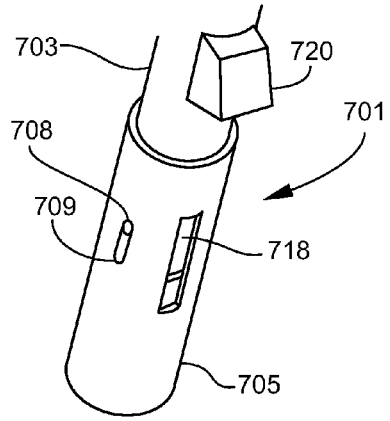

Referring now to FIGS. 25*a* and 25*b*, the waste collection device may be further equipped with an automatic scoop locking mechanism adapted to hold the scoop in the loading position. Locking mechanism 701 comprises generally a flexible latch 702 attached to the back of a scoop cup 712, and a slotted tube 705 fitted over the end of a drive member 703. A compression spring 706 is disposed between the lower end of drive member 703 and the closed bottom of slotted tube 705, biasing tube 705 downward, away from the end of drive member 703. The range of downward and upward deflection of tube 705 is limited by a dowel pin 708 projecting from the sides of drive member 703 into vertical limit slots 709 in the sides of tube 705. Flexible latch 702 is made of a tough polymer such as nylon, with a flexing section 714 proximate the end attached to cup 712, and a catch 716 at the other end. The latch 702 is positioned on cup 712 such that the catch 716 aligns with a rectangular latch slot 718 in slide tube 705, as well as an opening 719 in drive member 703 directly behind slot 718.

In FIG. 25*a*, the scoop is shown in the locked position, wherein slide tube 705 is all the way down, and the catch 716 is up against the top of latch slot 718, hooked behind the inner wall of tube 705. When an operator presses down on the handle to initiate the dispensing motion, tube 705 slides upward on drive member 703, raising the latch slot 718 relative to latch 702, and thereby releasing catch 716. With the scoop released, the dispensing motion is free to proceed by continuing the downward pressure on the handle.

The automatic locking of the scoop occurs when the scoop swings back down to the loading position after a dispensing step. As previously described, the return motion to the scooping position begins by operator releasing the downward pressure on the handle, and lifting the waste collection device away from the ground. The effect of doing so on the locking mechanism is to remove the upward force being applied to sliding tube 705, allowing spring 706 to move tube 705 back down to the position of FIG. 25*a*. As the scoop arm and cup swing down, the beveled front of catch 716 encounters the top of latch slot 718, driving latch 702 downward as the slot slides across the bevel. A resilient bumper 720 disposed between the cup and drive member is slightly compressed at the same time. As the catch clears slot 718, latch 702 snaps back up to the locked position of FIG. 25*a*, catching the drive member via tube 25, and locking the cup and scoop in the loading position. The bumper 720 provides a slight pushing force tending to move the cup away from the drive member, thereby pulling the catch 716 forward and tight against the inside wall of tube 25.

Locking mechanism 701 is one example of many possible variations or mechanisms capable of performing the same type of function. For example, the system of FIG. 25 could simply be inverted, with the latch on the drive member, and slot or other device for receiving the latch on the cup or scoop arm. Alternatively a locking mechanism could be configured in a different location, such as higher up on the drive member, or at the scoop hub. A remotely located mechanism may comprise for example a flexible latch similar to latch 702, or a spring loaded latch such as a pivoting pawl device that automatically latches when the scoop reaches the loading position. In such a device, a push rod or pull cable may be used to release the latch, wherein the rod or cable is actuated for example by downward pressure on the handle, or by pulling a trigger or lever.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A waste collection device comprising:

a frame with a grip portion at an upper end thereof;

a waste receptacle with an open end and a closed end, the waste receptacle positioned such that the open end is above the closed end; and a scoop adapted to swing about a pivot between a loading position and a dispensing position, wherein a) the pivot is below the open end of the waste receptacle, b) the scoop extends generally away from the upper end of the frame in the loading position, and c) an open end of the scoop is generally juxtaposed with the open end of the waste receptacle in the dispensing position.

2. The waste collection device of claim 1, further comprising an actuating mechanism adapted to rotate the scoop between the loading and dispensing positions.

3. The waste collection device of claim 2, wherein the actuating mechanism comprises a drive member movably connected to the frame.

4. The waste collection device of claim 3, wherein the drive member is pivotally connected to the frame, and a hub portion of the scoop is pivotally connected to the drive member.

5. The waste collection device of claim 4, wherein one end of a link is connected to the frame at a point below the drive member connection, and the other end is movably connected to the hub portion of the scoop, such that pivoting the drive member toward the dispensing position moves the link relative to the scoop hub, causing the scoop to rotate toward the waste receptacle.

6. The waste collection device of claim 5, further comprising a return spring configured to bias the scoop and drive member toward the loading position.

7. The waste collection device of claim 6, further comprising a latch for holding the scoop in the loading position.

8. A hand-held device for picking up a waste material deposit from the ground, comprising:

a handle having a grip portion at one end;

a movable scoop adapted to slide underneath and retain a waste material deposit;

a waste receptacle with an open end and a closed end, the open end positioned above the closed end; and an actuating mechanism adapted to move the scoop between a loading position in which the scoop is substantially below the waste receptacle, and a dispensing position in which the scoop is juxtaposed with the open end of the waste receptacle.

9. The hand held device of claim 8, wherein the actuating mechanism comprises a drive member movably connected to the handle, and wherein a lower end of the drive member is substantially below the closed end of the receptacle.

10. The hand held device of claim 9, wherein the drive member is pivotally connected to the handle, and a hub portion of the scoop is pivotally connected to the drive member.

11. The hand held device of claim 10, wherein one end of a link is connected to the handle at a point below the drive member connection, and the other end is connected to the hub portion of the scoop, such that pivoting the drive member toward the dispensing position causes the scoop to rotate toward the waste receptacle.

12. The hand held device of claim 11, wherein a portion of the end of the link connected to the hub portion is wrapped over and at least partially around the hub, and moving the drive member toward the dispensing position rotates the hub and the scoop.

13. The hand held device of claim 10, wherein the handle and drive member are configured such that when the end of the drive member is in contact with the ground, a downward load applied to the grip portion of the handle creates a moment tending to pivot the drive member toward the dispensing position.

14. The hand held device of claim 8, further comprising a return spring configured to bias the scoop toward the loading position.

15. A method for using a hand-held waste collection apparatus to collect waste material deposits, comprising:

holding the waste collection apparatus in a loading position, with a scoop portion of the apparatus facing a waste material deposit, and positioned substantially below a waste receptacle portion of the apparatus;

scooping the waste material into the scoop portion;

moving the scoop portion upward toward an open end of the waste receptacle portion of the apparatus; and abruptly stopping the motion of the scoop portion proximate the open end of the waste receptacle portion such that the waste material deposit is ejected into the waste receptacle portion.

16. The method of claim 15, wherein moving the scoop portion comprises swinging the scoop portion about a pivot over at least ninety degrees of rotation.

17. The method of claim 16, wherein swinging the scoop portion about a pivot is accomplished by operating an actuating mechanism.

18. The method of claim 17, wherein operating the actuating mechanism comprises applying a downward force to a handle portion of the apparatus while a drive member portion of the apparatus is in contact with the ground.

19. The method of claim 18, wherein the scoop portion comprises a cup at the end of an arm that is pivotally connected to the drive member portion at the pivot.

20. The method of claim 15, wherein the waste material is ejected from the scoop portion into the waste receptacle portion in a substantially downward direction.

21. A hand-held device for picking up a waste material deposit from the ground, comprising:

a frame having a grip portion at an upper end of an upper portion of the frame;

a waste receptacle with an open end and a closed end, the waste receptacle attached to the frame and oriented with the open end above the closed end; and a scoop pivotally attached to a lower portion of the frame, and moveable between a loading position in which the scoop is substantially below the open end of the waste receptacle, and a dispensing position in which the scoop is juxtaposed with the open end of the waste receptacle, wherein moving the scoop from the loading to the dispensing position comprises rotating the scoop at least 180 degrees.

22. The hand-held device of claim 21, wherein the upper and lower portions of the frame are pivotally connected, and wherein a lower end of the lower portion of the frame is proximate the scoop when the scoop is in the loading position.

23. The hand-held device of claim 22, wherein pushing down on the grip portion while the lower end of the lower portion of the frame is in contact with the ground causes the scoop to move from the loading position toward the dispensing position.

* * * * *